United States Patent [19]

Abbey

[11] 4,203,701

[45] May 20, 1980

[54] SURGE CONTROL FOR CENTRIFUGAL COMPRESSORS

[75] Inventor: William C. Abbey, Houston, Tex.

[73] Assignee: Simmonds Precision Products, Inc., Tarrytown, N.Y.

[21] Appl. No.: 935,833

[22] Filed: Aug. 22, 1978

[51] Int. Cl.[2] ..... F04D 27/02

[52] U.S. Cl. ..... 415/1; 415/11

[58] Field of Search ..... 415/11, 17, 1, DIG. 1, 415/37

[56] References Cited

U.S. PATENT DOCUMENTS

| | | | |
|---|---|---|---|
| 3,292,845 | 12/1966 | Hens et al. | 415/1 |
| 3,292,846 | 12/1966 | Harper et al. | 415/1 |
| 3,876,326 | 4/1975 | Weitz | 415/17 |
| 4,139,328 | 2/1979 | Kuper | 415/1 |
| 4,156,578 | 5/1979 | Agar et al. | 415/1 |

*Primary Examiner*—Everette A. Powell, Jr.
*Attorney, Agent, or Firm*—Edwin E. Greigg

[57] ABSTRACT

A surge control system for a centrifugal compressor having a recycle line between the discharge and suction, modulates flow in the line in accordance with molecular weight and temperature of the gas being compressed, pressure drop across the inlet orifice, and pressure drop across and power input to the compressor. The system is based on the standard relation that the product of the gas constant times the pressure drop across the inlet orifice divided by the suction temperature equals the pressure drop across the compressor.

4 Claims, 3 Drawing Figures

FIG.1
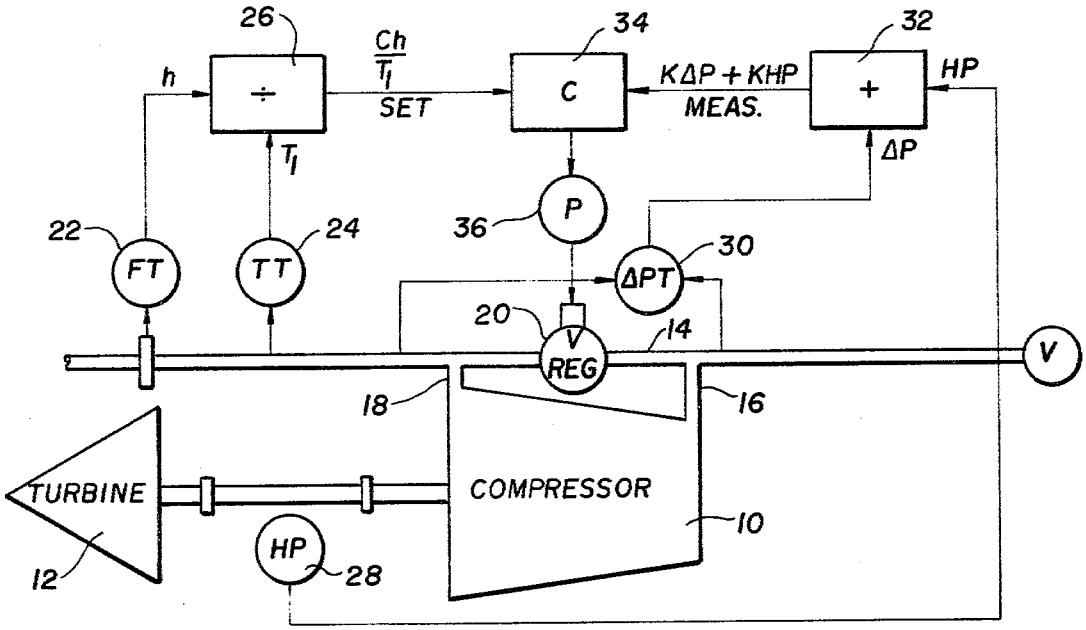
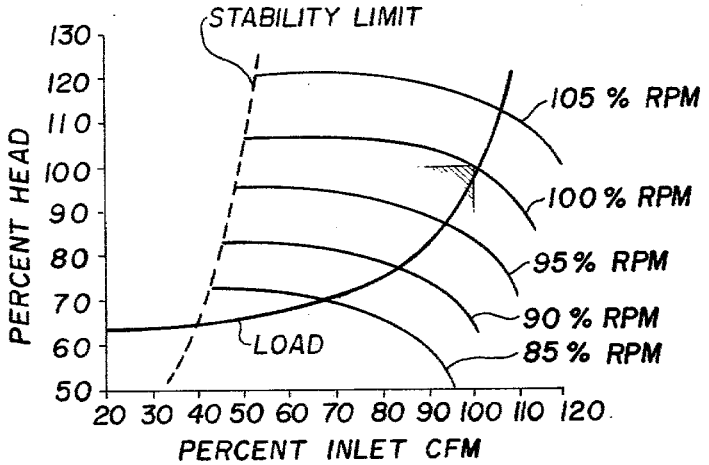
FIG.2
FIG.3
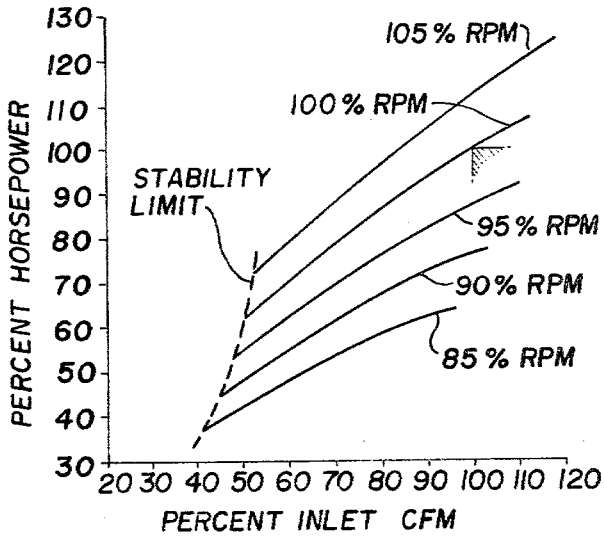

SURGE CONTROL FOR CENTRIFUGAL COMPRESSORS

BACKGROUND OF THE INVENTION

As is well known to those skilled in this art, the most efficient compressor operation is one where the centrifugal compressor operates as closely as possible to the surge line without actually going into surge. Quite apart from the efficiency aspect, however, it is also well known that a surging compressor results in excessive vibration and possibly destructive damage.

There are numerous systems in the prior art for control of the flow of gases in a recyle line connected between the discharge and intake of a centrifugal compressor for the purpose of positively preventing the compressor from going into surge. U.S. Pat. No. 3,292,846 dated Dec. 20, 1966, shows a control system of this type in which flow in the recycle line is made responsive to density of the discharge gas and the speed of the compressor to maintain a sufficient flow through the compressor to prevent surging thereof.

Another prior U.S. Pat. No. 3,876,326 dated Apr. 8, 1975, utilizes a computer controlled bleed valve connected to an intermediate stage of the compressor. Computer inputs in this system include speed of the compressor shaft, input horsepower, and inlet and outlet parameters of the gas flow.

BRIEF DESCRIPTION OF THE INVENTION

The control system of the present invention modulates flow in a recycle line connected between the compressor discharge and suction in a manner permitting the closest possible approach to surge conditions without permitting actual surge. The control system is based on the standard equation $Ch/T_i=\Delta P$ in which C is the gas constant, h is the differential pressure across the inlet orifice, $T_i$ is the suction temperture, and $\Delta P$ the differential pressure across the compressor. In the actual control system, conventional sensors sense the suction temperature and pressure drop across the inlet orifice and these signals are fed to a divider to provide an output signal proportional to $Ch/T_i$. At the same time, the horsepower input to the compressor is sensed along with the pressure drop across the compressor and their sum is then fed to a sum or difference amplifier. Both signals are then compared with a controller whose output signal is converted to a pneumatically varying signal which controls the setting of a valve in the recycle line.

BRIEF DESCRIPTION OF THE DRAWINGS

FIG. 1 is a diagram of a preferred embodiment of the control system of the present invention; and FIGS. 2 and 3 are typical variable speed performance curves for centrifugal compressors.

DETAILED DESCRIPTION OF THE PREFERRED EMBODIMENT

Referring to FIG. 1, the compressor 10 is shown coupled to a prime mover shown as a turbine 12. A recycle line 14 interconnects the compressor discharge 16 and suction inlet 18. A modulating valve 20 is connected in the line 14 inbetween the suction and discharge connections in order to exert a constant control over the amount of gas which is recirculated from the discharge to the inlet of the compressor.

The remaining portion of FIG. 1 schematically illustrates the system for controlling the valve 20 in accordance with the desired system parameters. A first sensor 22 provides a signal proportional to the pressure across the inlet orifice while the sensor 24 provides a signal proportional to the suction temperature. These are fed to a divider 26 which provides an output signal proportional to $Ch/T_i$.

Sensor 28 provides a signal proportional to the compressor power input and sensor 30 provides a signal proportional to the pressure drop across the entire compressor. The horsepower and pressure drop signals are fed to an adder 32. The thus obtained control signals are fed to a three terminal controller 34 with non-reset windup. The output of 34 feeds a current to air pressure transducer 36 to provide the necessary pneumatic control for the valve 20.

The pressure and temperature sensors 22, 24, and 30 may be standard commercial instrumentation transmitters currently avaialble from a number of domestic manufacturers. The horsepower sensor 28 may be a unit manufactured by the assignee of the present invention and marketed under the trademark "MONITORQUE." The dividing and summing network modules are also standard electronic modules readily available on the commercial market in this country.

The control system of the present invention in addition to the energy saving aspect permitted by operating closer to actual surge conditions is also unique in that it compensates for the variations in the molecular weight of the compressed gases. The system is applicable directly to the compressor manufacturer typical performance curves instead of derived or theoretical curves.

From the foregoing, it will be apparent to those skilled in this art that there is herein shown and described a novel and useful control system for a centrifugal compressor having a recycle line. While a preferred embodiment has been herein shown and described, Applicant claims the benefit of a full range of equivalents within the scope of the appended claims.

I claim:

1. Apparatus for surge control of a centrifugal compressor comprising in combination:
   - means deriving signals proportional to suction temperature and pressure differential across the inlet orifice of the compressor;
   - means for dividing said pressure signal by said temperature signal to provide a first control signal;
   - means for deriving signals proportional to power input to and pressure drop across the compressor;
   - means for adding said power and pressure drop signals to provide a second control signal;
   - a recycle line connecting the inlet and outlet of the compressor;
   - valve means in said recycle line; and
   - means for modulating flow in said recycle line by controlling said valve in accordance with said first and second control signals so that $Ch/T_i=\Delta P$ irrespective of variations in the composition of gases being compressed where
     - C is a gas constant,
     - h is pressure across a compressor inlet orifice,
     - $T_i$ is the suction temperature, and
     - $\Delta P$ is the pressure drop across the compressor.

2. Apparatus as defined by claim 1 in which said signals are all electrical, said drive means is pneumatically actuated and said apparatus includes transducer means connected to convert said control signals to air pressure signals and feed the resultant to said valve means.

3. In combination:

a centrifugal compressor having a recycle line connected between its suction and discharge sides;

a pneumatically operated modulating valve in said line;

means for deriving a first electrical analog of pressure drop across an inlet orifice;

means for deriving a second electrical analog of suction temperature;

means for dividing said first by said second analog to provide a first control signal;

means for deriving a third analog of power input to said compressor;

means for adding said third and fourth analogs to provide a second control signal;

means for combining said control signals;

means for converting the combined signal to a pneumatic signal; and means for controlling said valve in accordance with said pneumatic signal.

4. A method of operating a centrifugal compressor having a recycle line between the suction and discharge which comprises:

sensing the suction temperature and pressure differential across an inlet orifice;

dividing said differential pressure by said suction temperature to provide a first control signal;

sensing power input to said compressor and pressure drop across said compressor;

adding said sensed power input and pressure drop signals to provide a second control signal; and modulating the flow through said recycle line in accordance with said first and second control signals to prevent surging of said compressor.

* * * * *